US005228534A

United States Patent [19]

Haroldson, Sr.

[11] Patent Number: 5,228,534

[45] Date of Patent: Jul. 20, 1993

[54] PORTABLE SCAFFOLD APPARATUS

[76] Inventor: Acey A. Haroldson, Sr., 14025 NW. 23rd Ave., West Des Moines, Iowa 50265

[21] Appl. No.: 886,422

[22] Filed: May 20, 1992

[51] Int. Cl.[5] ..... E04G 1/20

[52] U.S. Cl. ..... 182/63; 182/15; 182/17; 280/79.11

[58] Field of Search ..... 182/63, 12–17, 182/127, 145, 141; 280/47.34, 79.11; 248/129

[56] References Cited

U.S. PATENT DOCUMENTS

| | | | |
|---|---|---|---|
| 1,122,805 | 12/1914 | Schertz | 280/47.34 |
| 1,310,028 | 7/1919 | Mahan | 280/79.11 X |
| 2,763,491 | 9/1956 | Thorwaldson | 280/79.11 X |
| 3,282,376 | 11/1966 | Merriman | 182/17 |
| 3,319,974 | 5/1967 | Ashley | 280/79.11 X |
| 3,614,993 | 10/1971 | Penso | 182/16 |
| 3,923,320 | 12/1975 | Faureau et al. | 182/174 |
| 4,171,033 | 10/1979 | Rust et al. . | |
| 4,442,919 | 4/1984 | Fulcher . | |
| 4,877,107 | 10/1989 | Anderson . | |
| 4,934,720 | 6/1990 | Dobron | 280/79.11 |
| 5,000,468 | 3/1991 | Weinstein | 280/47.34 |
| 5,022,490 | 6/1991 | Wyse . | |
| 5,067,587 | 11/1991 | Mims, Jr. et al. . | |

*Primary Examiner*—Alvin C. Chin-Shue
*Attorney, Agent, or Firm*—Henderson & Sturm

[57] ABSTRACT

A portable scaffold has a frame with a pair of spaced apart, longitudinal members which are essentially parallel to the direction of forward travel of the frame. The frame has a plurality of wheel assemblies attached to each corner thereof with pneumatic tires thereon so that the frame can travel over public roads or the like. A scaffold structure is attached to the longitudinal members by an attachment structure which will telescope between a narrow length which is within legal limits for highway travel. Similarly, transverse members connecting the longitudinal frame members together are provided which also can be telescoped between a narrow distance for legal travel down a public highway and a wider distance which provides the necessary base of a platform for the scaffold so that the scaffold can extend higher than would otherwise be permissible if the portable platform could not be widened.

5 Claims, 2 Drawing Sheets

PORTABLE SCAFFOLD APPARATUS

TECHNICAL FIELD

The present invention relates generally to a portable scaffold, and more particularly to such a portable scaffold base which is adjustable so that it can be narrow enough to travel over public roads from place to place and when it arrives at a construction site, it can be widened for use to conform to government regulations that require that the base be of adequate width to accommodate a scaffold of a particular height.

BACKGROUND ART

Scaffolds typically must be disassembled when they are moved from place to place and then re-assembled at the construction site. This is, of course, a time consuming operation in a business where time is money.

At a construction site, it is often necessary to move a scaffold from one position to another. That is one reason why caster-type wheels have been used on certain scaffolds, for example as shown in U.S. Pat. No. 5,022,490 to Wyse. A disadvantage of this type of caster wheel construction is that when it becomes necessary to move the scaffold over a public road or the like to a different construction site, these caster wheels are essentially useless during the moving process.

The higher an elevated platform on a scaffold is from the ground, the wider the base of such scaffold needs to be for safety reasons. In fact, there are government regulations specifying how wide the base of a scaffold must be as a function of how high the scaffold is. Consequently, additional structure is required to be assembled or disassembled in order to provide the necessary platform width in prior art scaffold structures.

Consequently, there is a need for a portable scaffold which overcomes the aforementioned problems.

DISCLOSURE OF THE INVENTION

The present invention relates to a portable scaffold, including a frame having a pair of spaced apart, longitudinal members which are essentially parallel to the direction of forward travel of the frame. The frame has a plurality of wheel assemblies attached to each corner thereof with pneumatic tires thereon so that the frame can travel over public roads or the like. A scaffold structure is attached to the longitudinal members by an attachment structure which will telescope between a narrow length which is within legal limits for highway travel. Similarly, transverse members connecting the longitudinal frame members are provided which also can be telescoped between a narrow distance for legal travel down a public highway and a wider distance which provides the necessary base of a platform of the scaffold so that the scaffold can extend higher than would otherwise be permissible if the portable platform could not be widened.

An object of the present invention is to provide an improved portable scaffold apparatus.

Another object of the present invention is to provide a portable scaffold platform which can be adjusted to be narrow enough to travel over public highways and which can be widened at the construction site to produce a wider base for a scaffold so that a higher scaffold can be used than could be used if the portable scaffold platform could not be so widened.

A further object of the present invention is to provide a scaffold apparatus which can be easily moved from place to place on the construction site itself over short distances and which can furthermore be towed over a public highway from one construction site to another over long distances.

A still further object of the present invention is to provide a portable scaffold platform which does not need to be disassembled and re-assembled when moving it from one construction site to another, but instead only needs to be adjusted between a transport position and a use position at the construction site.

Other objects, advantages, and novel features of the present invention will become apparent from the following detailed description of the invention when considered in conjunction with the accompanying drawings.

BEST MODE FOR CARRYING OUT THE INVENTION

Figure 1:
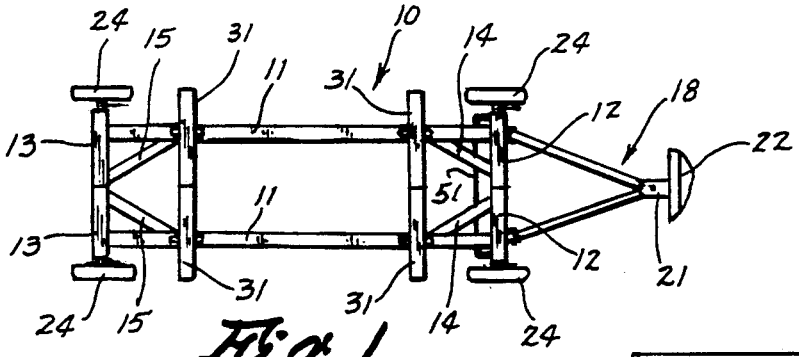
FIG. 1 is a top plan view of a portable scaffold platform in its transport position wherein it can be towed over public roads.

Referring now to the drawings wherein like reference numerals designate identical or corresponding parts throughout the several views, FIG. 1 shows a portable scaffold apparatus (10) constructed in accordance with the present invention. The scaffold (10) includes a pair of longitudinal members (11). The frame of the portable scaffold (10) also includes a pair of front cross members (12) and a pair of rear cross members (13). Besides attaching to the longitudinal members (11), the front cross members (12) include a brace (14) interconnecting longitudinal members (11) and (12) and braces (15) which interconnect longitudinal members (11) with rear cross members (13).

Figure 6:
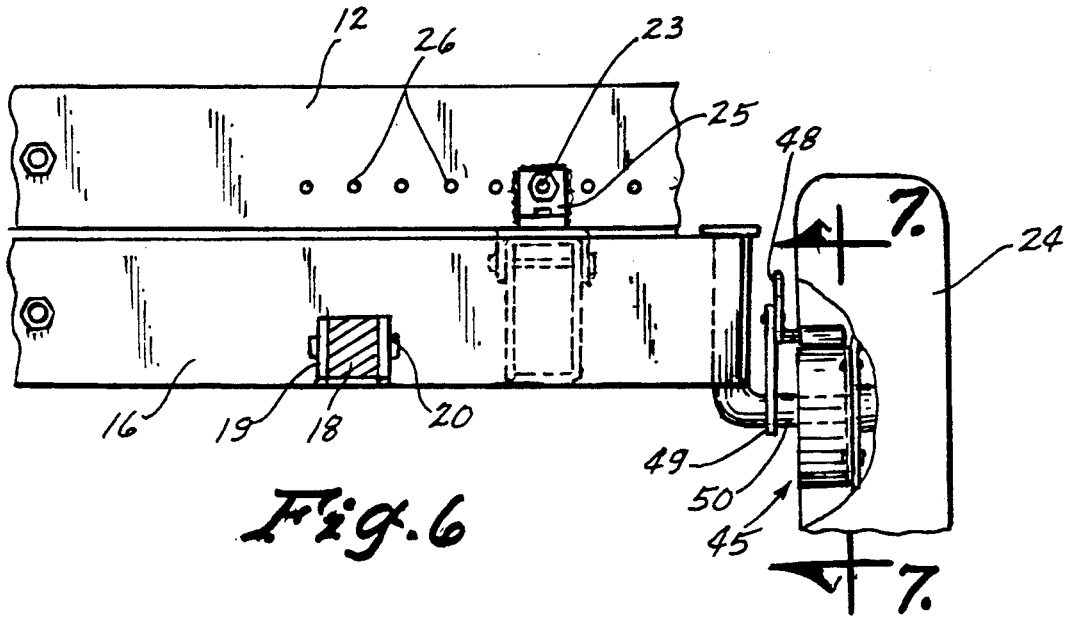
FIG. 6 is an enlarged cross sectional view taken along line 6—6 of FIG. 2 and showing how the cross members of the frame of the portable platform can be adjusted between the FIG. 1 and FIG. 2 positions.

The cross members (12) essentially slide on top of and are somewhat telescopic with another front structural member (16), as can best be seen in FIG. 6. A rear member (17) is essentially identical with the front member (16) except that the front member (16) has a towing assembly (18) pivotally attached thereto by brackets (19) and pins (20) (FIG. 6). A trailer hitch (21) allows the entire portable scaffold (10) to be towed by a towing vehicle (22).

Figure 2:
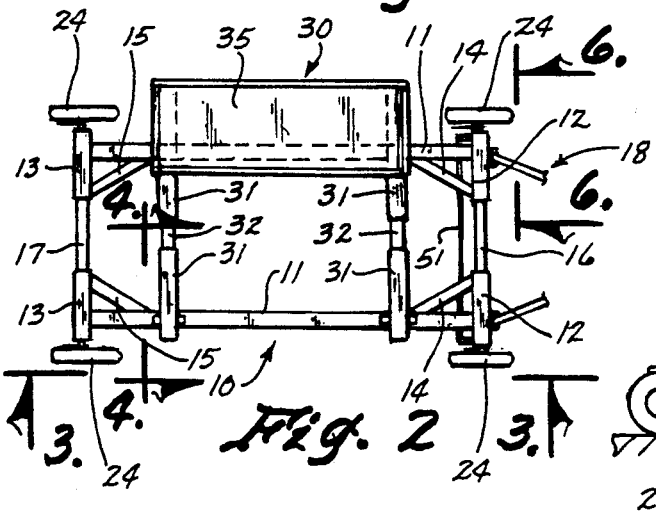
FIG. 2 is a top plan view like FIG. 1, but showing the platform extended and having a scaffold attached thereto.

The width of the portable platform (10) can be adjusted by removing the nut and bolt assembly (23) shown in FIG. 6 for both the front and rear members (16) and (17) and then the entire frame lengthened to the position shown in FIG. 2 wherein the wheel assemblies (24) are moved apart. The nut and bolt assembly (24) would then be re-inserted through the opening in brackets (25) and through a different opening of the set of openings (26) in members (12) and (13).

Figure 3:
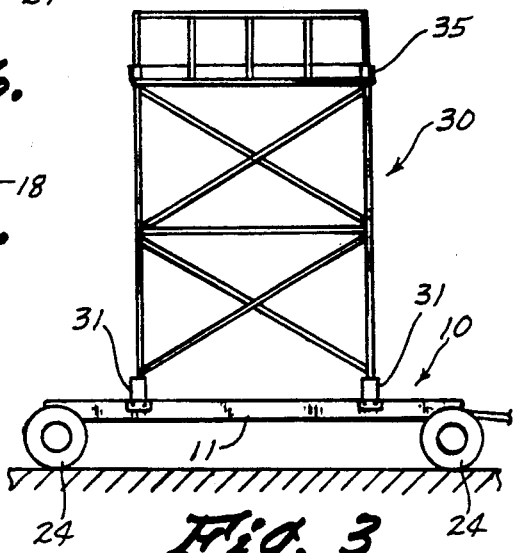
FIG. 3 is a side elevational view taken along line 3—3 of FIG. 2 and showing the portable scaffold platform with a scaffold apparatus attached thereto.

A scaffold structure (30) as shown in FIG. 3 can be attached to telescoping attachment brackets (31) which has another telescoping member (32) therein. Openings (33) and member (32) are provided for receiving nut and bolt assembly (34) so that removable of the nut and bolt assembly (34) allows the members (31) and (32) to telescope between the position shown in FIG. 1 and the position shown in FIG. 2.

If it is desired to tow the structure shown in FIG. 1 over the highway, then of course the nut and bolt assembly (34) would be used to hold the members (31) and (32) from telescoping. When the apparatus (10) arrives at the construction site to be used, and once it is in position, the nut and bolt assembly (34) is removed, the apparatus is lengthened to the position shown in FIG. 2 and the nut and bolt assemblies (34) are re-inserted in order to hold the platform in the position shown in FIG. 2 so that the scaffold (30) can be attached thereto. A platform (35) can only be of a limited height, depending upon how wide the base platform is, so that the widening of the platform from the position shown in FIG. 1 to the position shown in FIG. 2 permits the height of the platform (35) to be increased significantly.

Figure 4:
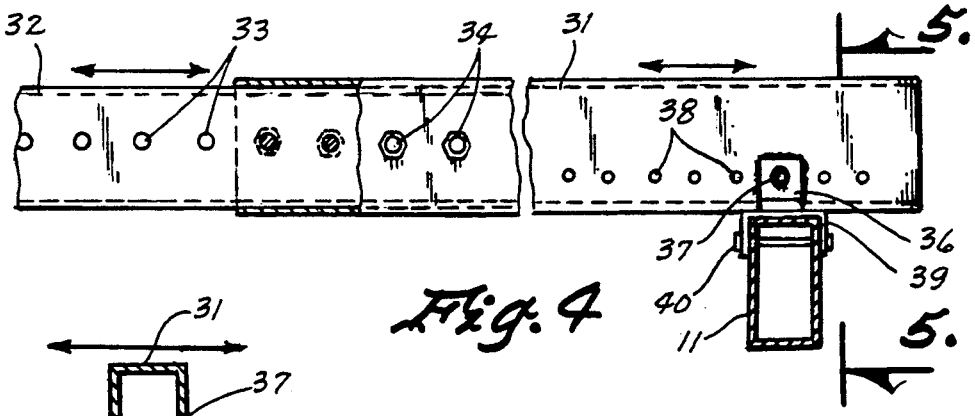
FIG. 4 is an enlarged partial cross sectional view taken along line 4—4 of FIG. 2 and showing how the attachment structure for attaching the scaffold to the frame is adjustable in length.
Figure 5:
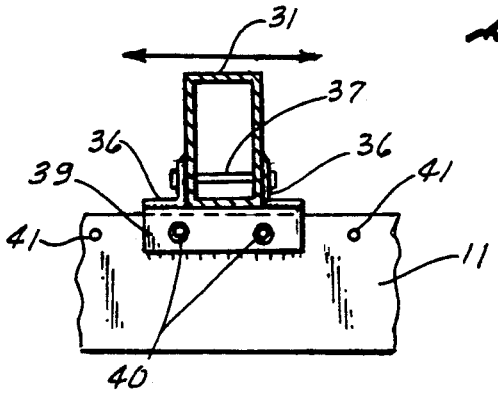
FIG. 5 is an enlarged cross sectional view taken along line 5—5 of FIG. 4.

Referring again to FIG. 4, it is also noted that some lengthening or shortening of the members (31) can also be accommodated because bracket (36) uses nut and bolt assembly (37) to extend through one or more of the openings (38) in member (31). Similar to the other adjusting mechanisms, removal of the nut and bolt assembly (37) and moving the member (32) to align with a different one of the holes (38) can be accommodated by then reinserting the nut and bolt assembly (37) to hold the member (37) with respect to the re-adjusted position of member (31) with respect to longitudinal member (11).

Additionally, bracket (39) can be adjusted forwardly or rearwardly along frame members (11) by removing nut and bolt fasteners (40). This permits the bracket, and consequently the cross member (31), to be moved forwardly or rearwardly until the openings in member (39), through which bolts (40) extend, are aligned with a pair of corresponding openings (41) in longitudinal members (11). This permits the attachment brackets (31) to be able to be adjusted to accommodate scaffolds (30) of differing lengths.

Figure 7:
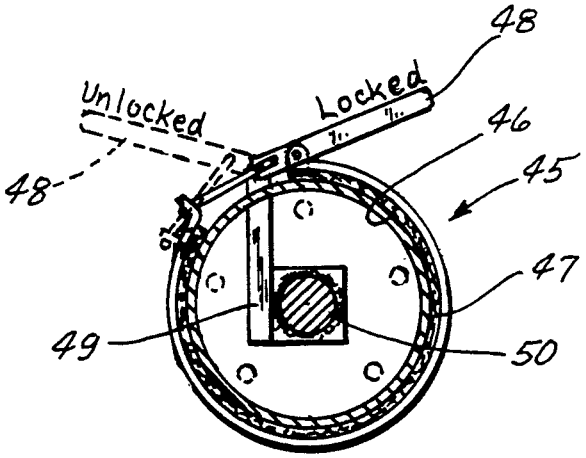
FIG. 7 is an enlarged cross sectional view taken along line 7—7 of FIG. 6 and showing how each one of the four wheels has a separate braking mechanism attached thereto for separately locking each one of the wheel assemblies.

Referring now to FIGS. 6 and 7, it is noted that a brake assembly (45) shown in FIG. 7 permits each one of the wheel assemblies (24) to be individually locked or unlocked. In the embodiment shown, a brake drum (46) has a brake shoe-like device (47) disposed therearound. A handle (48) has an over-the-center-type locking mechanism thereon so that when it is moved to the position shown in solid lines in FIG. 7, the brake shoe (47) is held tightly against brake drum (46). When the lever (48) is moved to the dashed line position shown in FIG. 7, the brake shoe (47) is loosened and the brakes are consequently released. By providing one of these braking mechanisms (45) on each of the wheel assemblies (24), the platform is much safer than it would otherwise be if less than all four wheels were locked.

Referring to FIG. 1, it is noted that a tie rod assembly (51) of a conventional design is used for steering purposes and that this tie rod assembly would also have a telescoping component so that it would not need to be disassembled between the FIG. 1 and FIG. 2 position thereof.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. A potable scaffold apparatus comprising:

a frame including a pair of spaced apart longitudinal members a plurality of paris of frame members including a pair of front frame members, a pair of rear frame members and at least one pair of intermediate frame members disposed transversely to said longitudinal members and connected at one end thereof to a respective one of said longitudinal members;

a plurality of connecting members operatively associated with the other ends of the respective plurality of pairs of frame members for permitting he respective pairs of frame members to be spaced apart at variable distances relative to one another;

a first wheel assembly operatively attached to a front right portion of said frame;

a second wheel assembly operatively attached to a rear right portion of said frame;

a third wheel assembly operatively attached to a front left portion of said frame;

a fourth wheel assembly operatively attached to a rear left portion of said frame;

a separate pneumatic rubber tire means operatively attached to each respective one of said first, second, third and fourth wheel assemblies for permitting said frame to be towed over public roads;

scaffold means for forming an elevated working platform above said frame; wherein said scaffold means is operatively associated with said at least one pair of intermediate frame members;

attachment means operatively associated with said at least one pair of intermediate frame members for attaching said intermediate frame member to said longitudinal members; and means for permitting said attachment means to be adjustable in a direction transverse to both said longitudinal members and said at least one pair of intermediate frame members.

2. The apparatus of claim 1 including means for attaching said frame to a vehicle for towing purposes.

3. The apparatus of claim 1 including locking means for selectively holding said plurality of pairs of frame members in a chosen length.

4. The apparatus of claim 1 including a separate brake means disposed on each respective one of said wheel assemblies for independently and selectively preventing said respective wheel assembly from turning for enhancing the safely of said scaffold during use.

5. The apparatus of claim 1 including at least one additional pair of intermediate frame members disposed transversely to said longitudinal members and adjustably connected at one end thereof to a respective one of said longitudinal members; wherein said attachment means are also operatively associated with said at least one additional pair of intermediate frame members for attaching said scaffold means to said frame; and, an additional connection member operatively associated with the other ends of said at least one additional pair of intermediate frame members for varying the spacing therebetween.

* * * * *